US007390334B2

(12) United States Patent
Kleker

(10) Patent No.: US 7,390,334 B2
(45) Date of Patent: Jun. 24, 2008

(54) METHOD FOR WASHING AND DRYING GARMENTS

(76) Inventor: Richard Kleker, 98 Price La., Pleasant Hill, CA (US) 94523

( * ) Notice: Subject to any disclaimer, the term of this patent is extended or adjusted under 35 U.S.C. 154(b) by 0 days.

(21) Appl. No.: 11/451,206

(22) Filed: Jun. 12, 2006

(65) Prior Publication Data

US 2006/0230542 A1 Oct. 19, 2006

Related U.S. Application Data

(63) Continuation of application No. 10/417,045, filed on Apr. 15, 2003, now Pat. No. 7,060,106.

(51) Int. Cl.
*D06F 17/00* (2006.01)
*D06F 37/00* (2006.01)

(52) U.S. Cl. ..... 8/149.1; 8/149.2; 8/149.3; 8/158

(58) Field of Classification Search ..... 8/149.1, 8/149.2, 149.3, 158; 68/5 R, 6, 5 C
See application file for complete search history.

(56) References Cited

U.S. PATENT DOCUMENTS

| | | | | |
|---|---|---|---|---|
| 3,664,159 | A * | 5/1972 | Mazza | 68/205 R |
| 3,672,188 | A * | 6/1972 | Geschka et al. | 68/205 R |
| 3,686,899 | A * | 8/1972 | Rosenfeld et al. | 68/3 R |
| 4,655,235 | A * | 4/1987 | Scott, Jr. | 134/99.1 |
| 5,205,306 | A * | 4/1993 | Peterson | 134/104.2 |
| 2006/0101867 | A1 * | 5/2006 | Kleker | 68/5 C |

* cited by examiner

*Primary Examiner*—Joseph L. Perrin

(57) ABSTRACT

A device for washing and drying garments or other items in a single unit. The garments or other items are placed in the device on conventional plastic hangers leaving space in between each item. A manifold with arms extends between the items. The manifold moves up and down so that the arms move up and down the length of the items to be treated. The arms have one set of pipes that spray wash water, rinse water and other washing liquids on the items. The arms have another set of pipes that carry air to the items, drying the items. After the cycle is complete the clothes or other items may be left in the device until needed.

18 Claims, 3 Drawing Sheets

METHOD FOR WASHING AND DRYING GARMENTS

CROSS REFERENCE TO RELATED APPLICATIONS

This application is a continuation application of U.S. patent application Ser. No. 10/417,045, filed on Apr. 15, 2003, now U.S. Pat. No. 7,060,106 which application is incorporated herein by reference.

FEDERAL SPONSORSHIP

Not Applicable.

BACKGROUND

A variety of machines in which clothes may be hung and processed in a single unit have been proposed. There are a series of patents that require the use of solvents for dry cleaning garments, for example U.S. Pat. No. 2,845,786, issued to E. L. Chrisman on Aug. 5, 1958; U.S. Pat. No. 3,166,923 issued to Zacks on Jan. 26, 1965; and U.S. Pat. No. 2,741,113, issued to Norkus on Apr. 10, 1056. The use of solvents, especially in the home, can create health and safety issues.

There are additional patents that claim a machine in which the clothes are "finished" only. These patents are directed toward de-wrinkling and smoothing the clothes, typically by using steam. However, these machines do not clean the clothes, these machines are used after the clothes are already clean. Some examples of these devices are seen in U.S. Pat. No. 3,707,855 issued to Buckley on Jan. 2, 1973; U.S. Pat. No. 4,391,602 issued to Stichnoth et al. on Jul. 5, 1983; U.S. Pat. No. 3,739,496 issued to Buckly et al. on Jun. 19, 1973; U.S. Pat. No. 3,732,628 issued to Bleven et al. on May 15, 1973; and U.S. Pat. No. 4,761,305 issued to Ochiai on Aug. 2, 1988. U.S. Pat. No. 6,189,346 issued to Chen et al. on Feb. 20, 2001 discloses a clothes treating apparatus that uses a "conditioning mist" as an alternative to dry-cleaning clothes. This patent does not provide for washing clothes with water or rinsing the clothes.

In addition, some patents claim machines that only dry clothes, and do not wash or finish the clothes: for example U.S. Pat. No. 3,257,739 issued to Wentz on Jun. 28, 1966; and U.S. Pat. No. 3,102,796 issued to Erickson on Sep. 3, 1963.

U.S. Pat. No. 3,114,919 issued to Kenreich on Dec. 24, 1963 discloses a machine that can wash and dry using conventional laundry soap, however, this apparatus can only wash one shirt, or the like, and one pair of pants, or the like, at a time. In addition, this patent discloses an apparatus that has fixed outlets for dispensing wash and rinse water. This patent, like U.S. Pat. No. 3,664,159 issued to Mazza on May 23, 1972, utilizes a shaking of the garments to remove dirt and debris from the garments. However, shaking the garments can cause the garments to fall during the washing cycle, and can impart wrinkles to the garments. In addition, these patents teach that the wash water is applied from the top and bottom of the clothing, and not along the length of the clothing.

Finally, U.S. Pat. No. 3,672,188 issued to Geschka et al. on Jun. 27, 1972 discloses an apparatus that uses conventional laundry soap water, and hot air to wash and dry clothes. However, in this patent the soap and water are applied to the garments from top and bottom nozzles. Likewise, in U.S. Pat. No. 3,868,835 issued to Todd-Reeve on Mar. 4, 1975, the water and soap are applied from nozzles located near the top and bottom of the apparatus. In neither of these apparatuses is the soap and water applied over the entire length of the garments.

SUMMARY OF THE INVENTION

The invention is generally designed to wash and dry garments or other items in a single machine. The invention is for use in residences or in hotel rooms, hospitals, laundromates, and other commercial applications. In a conventional clothes washing machine it is best to transfer the clothes soon after they are washed to the dryer in order to prevent wrinkling. In addition, it is even more important to rapidly remove dried clothes from the dryer shortly after completion of the drying process to further prevent wrinkling. When using the invention, there is no need to rapidly move clothes from the washing machine to the dryer, or to rapidly remove clothes from the dryer. The clothes are washed and dried on hangers in a single machine. Once the cycle is complete, the clothes may remain in the invention indefinitely, until ready to be worn, suspended from the hangers.

The device is used by placing garments on conventional hangers, and hanging the garments on bar within the machine cabinet. The inventor prefers to use plastic hangers, however any hanger that will support the garments without imparting stains to the wet garments may be used. A manifold supplies wash water, rinse water and finally hot air to the clothes. The manifold contains a series of arms, with one arm between each garment. The arms contain nozzles directed downward and toward the garments. The manifold, arms, and nozzles contain a dual internal system of pipes. One set of internal pipes allows wash water and rinse water to be directed toward the clothes. The other set of internal pipes allows hot air to be directed toward the clothes.

During operation, the wash water containing soap travels up the first set of internal pipes in the manifold, through the arms, out the nozzles, and onto the clothes. The entire manifold traverses up and down the length of the hanging clothes, spraying the clothes with soapy water.

After the wash cycle is complete, rinse water travels through the same first set of internal pipes in the manifold, and arms, and out the same nozzle. The manifold again traverses up and down the length of the hanging clothes, spraying the clothes with rinse water.

In the drying cycle hot or cool air travels through the second set of internal pipes in the manifold, through the arms, and out a separate set of nozzles and toward the clothes. The hot air may exit the apparatus through vents, or may be re-circulated through a compressor. The compressor will remove the moisture from the hot air and direct the hot toward the garments.

The duration of the washing cycle, rinse cycle, and drying cycle is controlled through a control panel.

When the clothes washing and drying cycle is complete the clothes may remain in the machine until such time as is convenient to remove the clothes.

DESCRIPTION OF THE INVENTION

Figure 1:
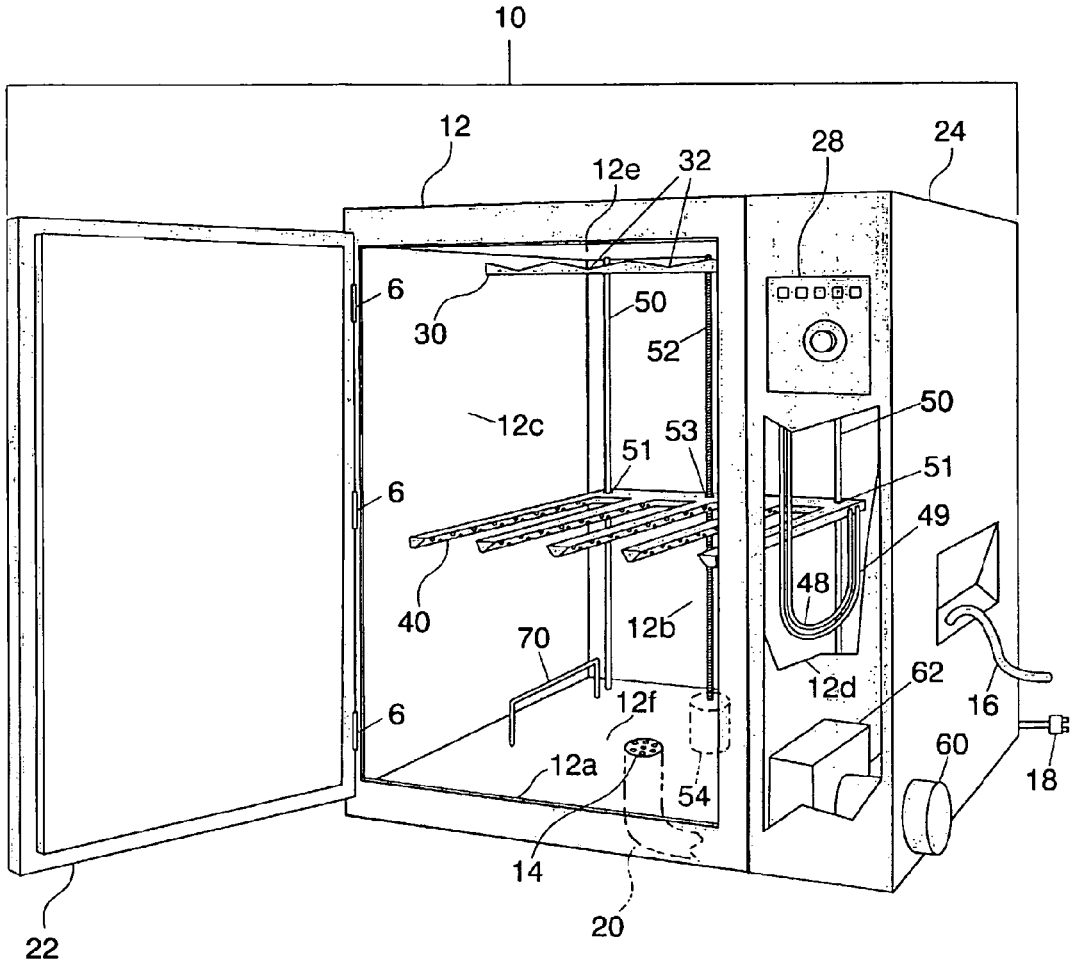
FIG. 1 is a perspective view, and shows the device from the front with the door open, and a cut-away section to see inside the sub-cabinet.

Apparatus 10 comprises a cabinet 12 with front wall 12*a*, rear wall 12*b*, two side walls 12*c* and 12*d*, and a top and bottom wall 12*e* and 12*f*. In the preferred embodiment said walls of cabinet 12 are insulated. Apparatus 10, like conventional washers and dryers, is connected to a water supply by hose 16, to an electrical supply by conductors 18, and to a drain by hose 20.

Bottom wall 12*f* contains drain 14. Drain 14 is connected to drain hose 20, and drains cabinet 12. Cabinet 12, which is sealed against the escape of water, is provided with a door 22 through which clothing to be processed can be inserted. In the preferred embodiment door 22 is transparent, and the garments may be viewed during the operating cycle. Alternatively, door 22 may be opaque and insulated. Door 22 is attached to cabinet 12 with one or more conventional hinges 6. Door 22 is closed and watertight during operation of the device. Door 22 may, but does not have to, extend the entire length of the front wall 12*a* of cabinet 12.

Cabinet 12 is adjacent to sub-cabinet 24. Sub-cabinet 24 contains the mechanism by means of which the operating cycle of apparatus 10 is automatically carried out. The operating cycle may include any variation or combination of pre-washing, washing, rinsing and drying. For means of illustration only, and not as a limitation, the device control mechanism could allow the consumer to set the device for heavy or light washing; set the water temperature; add bleach, fabric softeners, or other laundry additives; set one or more rinse cycles; set a initial delay of the start of the washing cycle to allow for the action of spot-removers; set a delay of the start of the washing cycle to accommodate the convenience of the user; set a pre-wash cycle; and set varying drying temperatures and times. The various washing and drying requirements are set via control panel 28. The electricity for running control panel 28, and all other parts of the device, is supplied through conductor 18.

The device requires the use of a control panel 28 to effectuate the different washing and drying needs of the user. Said control panel 28 includes a timer, a means for setting or programming the various washing and drying cycles, a means for dispensing laundry detergent, bleach, fabric softener, or other laundry additives, and a means for regulating the washing, rinsing, and dying times.

The clothes-receiving portion of cabinet 12 has, at its upper end, a hanging bar 30. Hanging bar 30 is suspended horizontally and parallel to walls 12*a* and 12*b*. Hanging bar 30 has one or more hanger spacers 32. Clothes, towels, sheets or other items to be laundered are placed on a conventional, non-rusting, hanger. The hanger is inserted onto hanging bar 30, and held at regularly spaced intervals by hanger spacers 32.

Manifold 40 is comprised of a plurality of arms 42. The arms 42 are in a single plane, and are parallel to each other, and perpendicular to hanging bar 30. The arms extend between hanger-mounted garments 26. The first arm in the parallel plane is 42*a*, and the last arm in the parallel plane is 42*z*.

Figure 2:
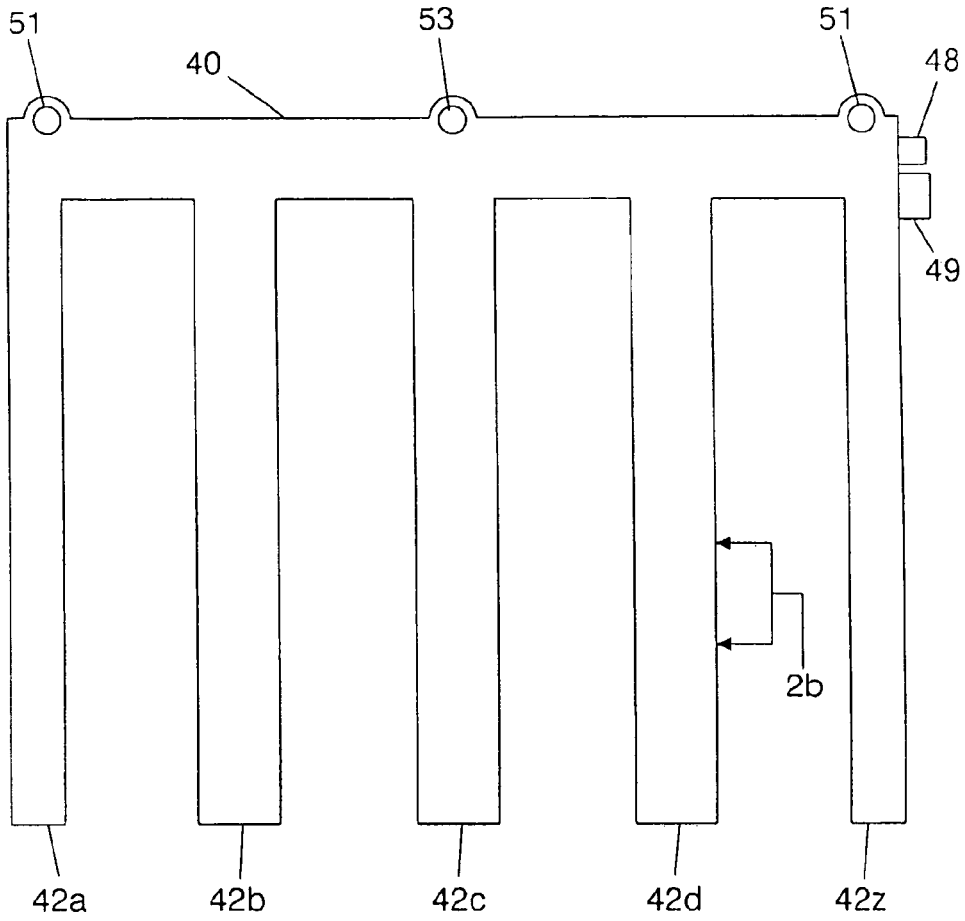
FIG. 2 is a plan view of the manifold.
Figure 2A:
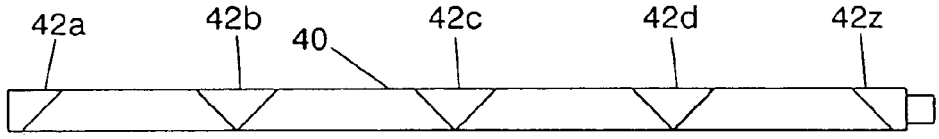
FIG. 2*a* is cross-sectional view of the manifold.
Figure 2B:
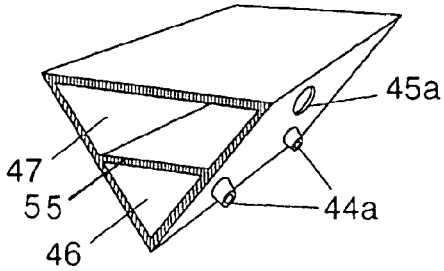
FIG. 2*b* shows a partial sectional view of the area indicated in FIG. 2.
Figure 3:
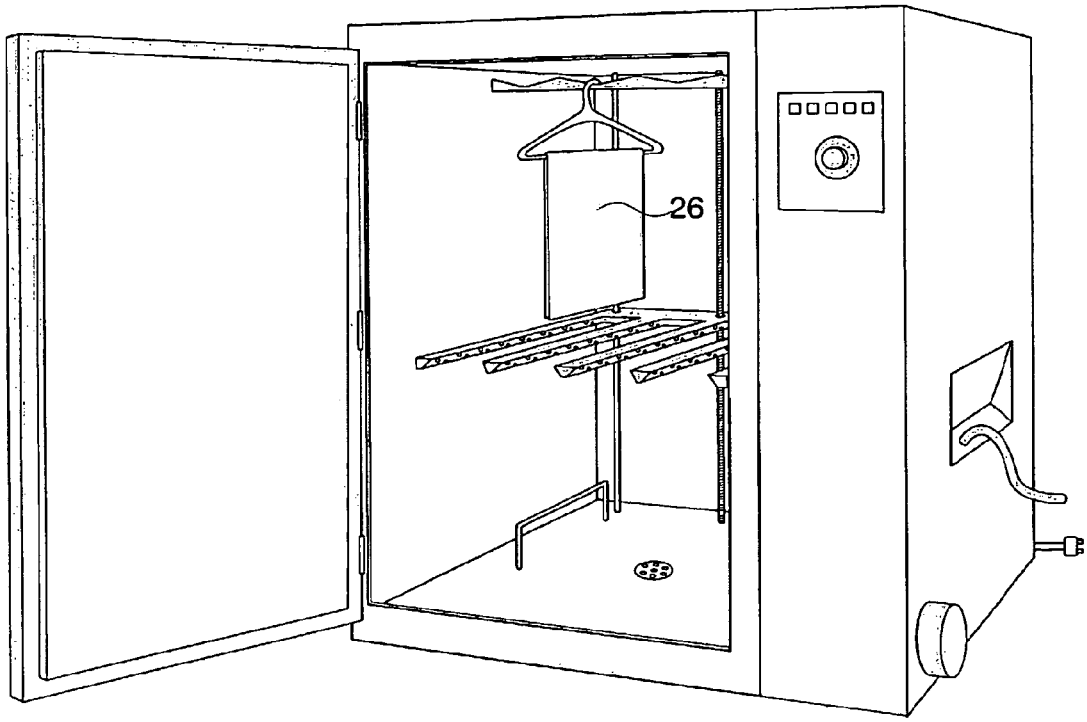
FIG. 3 is a perspective view without a cut-away.

Inside manifold 40 are two sets of internal pipes. One set is the liquid-carrying pipes 46. The other set is the air-carrying pipes 47. The liquid-carrying pipes 46 and air-carrying pipes 47 may be a separate set of internal pipes inside manifold 40. Alternatively, as shown in FIG. 2*b*, the manifold 40, liquid-carrying pipes 46, and air-carrying pipes 47 may be manufactured as a single unit with a divider 55 separating the air in the air-carrying pipes 47 from the water in the water-carrying pipes 46.

Water enters sub-cabinet 24 through water supply hose 16. Laundry detergent or other laundry additives may be added to the water, as requested by the user. For example, and for purposes of illustration and not limitation, laundry detergent may be added to the water. The water/detergent mixture then travels into manifold 40 and arms 42 through liquid-supply hose 48, and into manifold 40. Once inside manifold 40, the water/detergent mixture travels through liquid-carrying pipes 46. The water/detergent mixture exits arms 42 through liquid-exits 44 and sprays the hanger-mounted garments 26. Liquid-exits 44 may be either nozzles or holes. The inventor currently prefers to use nozzles for liquid-exits 44. Manifold 40 moves up and down the length of the hanger-mounted garments 26 spraying both sides of garments 26 with the water/detergent mixture. The water/detergent mixture will run off the garments 26, down to bottom wall 12*f*, through drain 14, and out drain nose 20. In the preferred embodiment bottom wall 12*f* will be sloped in such a manner that drain 14 is at the lowest point in bottom wall 12*f*, causing the water to run out drain 14, and exit the device through drain hose 20.

The drying cycle may be started after completion of the washing cycle. In the drying cycle warm or cool air is forced from subcabinet 24 to manifold 40 via air-supply hose 49, and then into manifold 40. Once inside manifold 40, the air travels through air-carrying pipes 47 and out air-exits 45. Air-exits 45 may be either nozzles or holes. The inventor currently prefers to use holes for air-exits 45. Manifold 40 again moves up and down the length of hanger-mounted garments 26 blowing air on both sides of garments 26, and thereby drying the garments 26.

In the preferred embodiment, each arm 42 has a plurality of liquid-exits 44 and air-exits 45. Arm 42*a* has a plurality of exits 44*a* and 45*a* on only the side facing toward garment 26, and arm 42*z* has a plurality of exits 44*z* and 45*z* on only the side facing toward garment 26. The remainder of arms 42 have a plurality of exits 44 and 45 on both sides of each arm 42 so that hanger-mounted garments 26 may be sprayed from both sides.

Liquid-exits 44 and air-exits 45 are placed on arms 42 so that the liquid or air exits arms 42 in a downward direction. The shape of the arms may be any shape that allows the liquid- and air-exits to point downward. The inventor currently prefers to have the cross-sectional shape of the arms be an isosceles triangle with the two equal sides of the triangle facing downward, and to place the liquid- and air-exits on the two downward facing sides of the triangle. The downward angle of the liquid or air may be any angle necessary to prevent garments 26 from tangling and twisting, and to help smooth garments 26. The inventor currently prefers to use a downward angle of between 40 degrees and 60 degrees on liquid-exits 44 and air-exits 45.

There are no specific requirements regarding placement of liquid-exits 44 and air-exits 45 relative to each other. That is, liquid-exits 44 and air-exits 45 may be placed in a horizontal line, may be placed with either on top of the other, or may be placed in any arrangement that allows liquid to exits the liquid-exits 44, and allows air to exit air-exits 45.

Manifold 40 has one or more unthreaded guide holes 51. Apparatus 10 contains one or more guide post 50. In the preferred embodiment, the number of unthreaded guide holes 51 is equal to the number to guide posts 50. Guide post 50 is a smooth post that runs in a vertical direction parallel to rear wall 12*b*. Guide post 50 is inserted through unthreaded hole 51 in manifold 40, and manifold 40 may freely move along the length of guide post 50.

Manifold 40 has one or more threaded screw holes 53. Apparatus 10 contains one or more screw posts 52. In the preferred embodiment, the number of threaded screw holes 53 is equal to the number of screw posts 52. Screw post 52 is a threaded post runs in a vertical direction parallel to rear wall 12*b*. Screw post 52 and threaded screw hole 53 are threaded so that the threaded screw post 52 will turn inside threaded screw hole 53 and, in turning, move manifold 40 either up or down.

Screw post 52 is moveably attached to motor 54. Motor 54 will turn screw post 52 in an alternating clockwise and counter-clockwise direction, thereby moving manifold 40 up and down screw post 52. Motor 54 may be programmed via control panel 28 so that screw post 54 turns in one direction for varying lengths of time. The length of time that screw post 54 turns in any one direction is directly correlated to the length that the manifold travels in any one direction. Thus, screw post 54 may turn for such a length of time that manifold 40 travels only part of the height of cabinet 12, or the entire length of cabinet 12. Control panel 28 may also provide a means for setting or programming the speed of the upward/downward motion, as well as the distance manifold 40 travels in the upward/downward plane.

Manifold 40 will continue to spray garments 26 for the length of time as set by the user. After the wash cycle is completed, the rinse cycle will begin. In the rinse cycle, water alone travels through liquid-supply hose 48 to manifold 40 and into arms 42 through liquid-supplying pipes 46. The water exits arms 42 through liquid-exits 44, and sprays the garments 26 with rinse water. The rinse water exits the device through drain 14 and drain hose 20.

The drying cycle will begin at the time requested by the user after the rinse cycle is complete. The inventor currently prefers to allow a length of time for passive dripping of water from the clothes before beginning the drying cycle. However, the drying cycle may be set to begin at any time, even immediately after completion of the rinse cycle. Ambient air will be drawn into sub-cabinet 24 through air-intake hose 61. If requested by the user, the air will be heated. The air will travel through air-supply hose 49 to manifold 40 and then into arms 42 through air-carrying pipes 48. The air exits through air-exits 45. Manifold 40 moves up and down the length of the garments 26 spraying air onto the garments. The heated air may exit cabinet 12 passively through vent 60. Alternatively, the heated air may be removed from cabinet 12 and processed through condenser 62, removing the moisture from the air. The treated air will then be returned to recirculate in cabinet 12

In the preferred embodiment the apparatus will indicate the end of the washing and drying cycle by a light or suitable alarm.

Although not required, in the preferred embodiment one or more racks 70 may be attached to bottom wall 12*f*. The rack 70 extends horizontally near the bottom of the cabinet 12. Socks or other small items may be placed on the rack 70 and treated as described above.

The invention claimed is:

1. A garment cleaning method comprising:

suspending the garment vertically;

spraying the suspended garment on both sides at the same time, using a manifold configured to direct a spray at the suspended garment;

directing a substantial portion of the spray from the manifold at a downward angle, at both sides of one or more locations on the suspended garment below a plane of the manifold to prevent garments from tangling and twisting; and translating the manifold vertically at least a portion of the vertical length of the garment, below an upper edge of the garment.

2. The method of claim 1, wherein the spray comprises a fluid.

3. The method of claim 2, wherein the fluid is water.

4. The method of claim 2, wherein the fluid is water mixed with a cleaning agent.

5. The method of claim 2, wherein the fluid is water mixed with a conditioning agent.

6. The method of claim 1, wherein the spray comprises a gas.

7. The method of claim 1, wherein spraying the suspended garment comprises spraying the suspended garment with a vapor.

8. The method of claim 7, wherein the vapor is steam.

9. The method of claim 1, further comprising beginning the vertical translation of the manifold below the garment.

10. The method of claim 1, further comprising beginning the vertical translation of the manifold between the upper edge of the garment and a lower edge of the garment.

11. The method of claim 1, wherein an angle of the downward direction is between about 40 degrees and 60 degrees.

12. A garment cleaning method comprising:

suspending the garment vertically;

spraying the garment using a manifold including two exits, each exit configured to direct a spray at a side of the garment opposite the other exit;

directing most of the spray from each of the two exits in a downward direction at opposite sides of about the same location of the garment below a generally horizontal plane of the manifold to prevent tangling and twisting of the garment; and translating the manifold vertically along at least a portion of the vertical length of the garment.

13. The method of claim 12, wherein an angle of the downward direction is between about 40 degrees and 60 degrees.

14. A garment cleaning method comprising:

suspending the garment vertically;

spraying the garment using a manifold including a first exit configured to direct a spray and a second exit configured to direct a spray at an opposite side of the garment from the first exit;

directing most of the spray from the first exit in a downward direction at a location on the garment below a generally horizontal plane of the manifold;

directing most of the spray from the second exit in a downward direction at about the same location on the opposite side of the garment to prevent tangling and twisting of the garment; and translating the manifold vertically along at least a portion of the vertical length of the garment.

15. The method of claim 14, wherein an angle of the downward direction is between about 40 degrees and 60 degrees.

16. The method of claim 14, wherein the spray comprises a fluid.

17. The method of claim 14, wherein the spray comprises a gas.

18. The method of claim 17, wherein the gas is steam or air.

* * * * *